US005435802A

United States Patent [19]

Kober

[11] Patent Number: 5,435,802

[45] **Date of Patent: * Jul. 25, 1995**

[54] FOLDER CONSTRUCTION

[75] Inventor: Kasimir Kober, Niles, Ill.

[73] Assignee: Chicago Dryer Company, Chicago, Ill.

[ * ] Notice: The portion of the term of this patent subsequent to Apr. 5, 2011 has been disclaimed.

[21] Appl. No.: 180,487

[22] Filed: Jan. 12, 1994

Related U.S. Application Data

[63] Continuation of Ser. No. 925,283, Aug. 4, 1992, Pat. No. 5,300,007, which is a continuation of Ser. No. 676,299, Mar. 27, 1991, abandoned.

[51] Int. Cl.[6] ..... B65H 45/04

[52] U.S. Cl. ..... 493/23; 493/418; 493/450

[58] Field of Search ..... 493/23, 25, 29, 418, 493/436, 450, 16, 19, 20, 27

[56] References Cited

U.S. PATENT DOCUMENTS

| | | | |
|---|---|---|---|
| 2,545,798 | 3/1951 | Sjostrom | 270/84 |
| 2,650,821 | 9/1953 | Howlett | 270/68 |
| 2,754,113 | 7/1956 | Sjostrom | 270/84 |
| 2,941,797 | 6/1960 | Buss | 270/69 |
| 3,094,321 | 6/1963 | Kamberg | 270/68 |
| 3,212,771 | 10/1965 | Kerman et al. | 270/69 |
| 3,252,700 | 5/1966 | Henry | 270/69 |
| 3,310,207 | 3/1967 | Gore | 223/39 |
| 3,396,878 | 8/1968 | Snayberger, Sr. et al. | 223/37 |
| 3,502,322 | 3/1970 | Cran | 270/69 |
| 3,656,741 | 4/1972 | Macke et al. | 270/66 |
| 3,749,632 | 7/1973 | Gibbons | 156/364 |
| 3,828,989 | 8/1974 | Heater | 223/37 |
| 3,829,081 | 8/1974 | Gerstenberger et al. | 270/66 |
| 3,980,290 | 9/1976 | Sjoman et al. | 270/66 |
| 4,059,257 | 11/1977 | Grantham | 270/66 |
| 4,060,227 | 11/1977 | Landgraf et al. | 270/66 |
| 4,093,205 | 6/1978 | Kober | 270/66 |
| 4,464,159 | 8/1984 | Grantham | 493/419 |

FOREIGN PATENT DOCUMENTS

| | | | |
|---|---|---|---|
| 3320381A1 | 6/1984 | Germany | D06F 89/00 |
| 1165730 | 10/1969 | United Kingdom | B65H 45/04 |

OTHER PUBLICATIONS

"Centrafold High Production Folding Machines" product brochure (date unknown).

*Primary Examiner*—Jack W. Lavinder

*Attorney, Agent, or Firm*—Willian Brinks Hofer Gilson & Lione

[57] ABSTRACT

A towel fed conveyor of continuous ribbons is provided which conveys a towel beneath spaced parallel runners which opposed lateral towel side panels being carried by conveying ribbons which slidably engage opposed supporting side plates. If the towel has less than a maximum length, air bars sequentially fold the towel side panels over the runners as the towel is moving and conveyed to the end of an upper feed conveyor. [The air discharges instantaneously urge each towel side panel in sequence against an air permeable grid disposed over the towel and feed conveyor as each panel is moved over the towel central panel.] The air blasts progressively squeeze air from between the side and central panels. [from the panel hinge connections with the towel central panel to the distal terminal ends of the side panels.]

26 Claims, 7 Drawing Sheets

Fig. 18
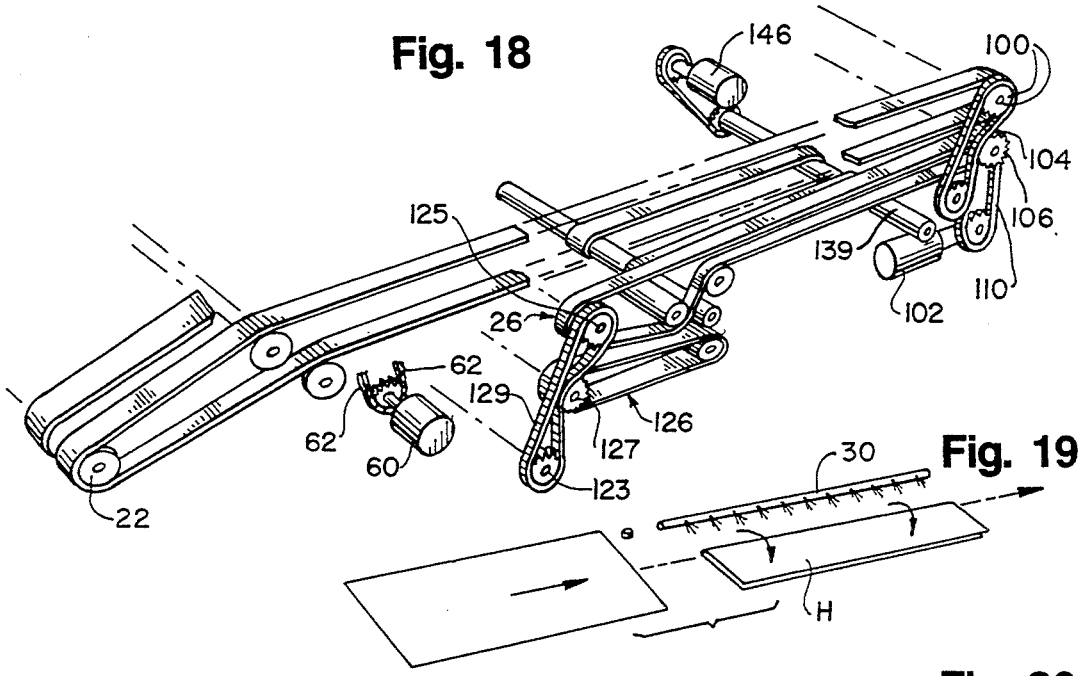
Fig. 19
Fig. 20
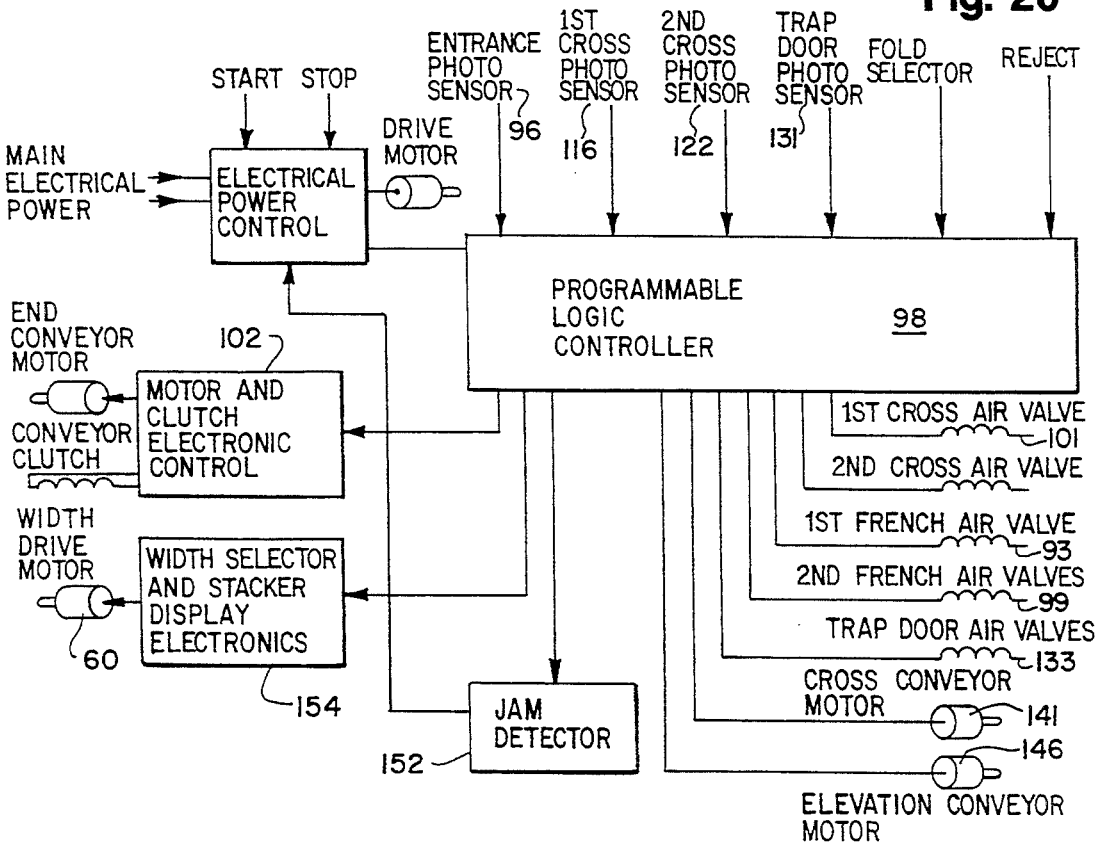

FOLDER CONSTRUCTION

This is a continuation of application Ser. No. 925,283, filed Aug. 4, 1992, now U.S. Pat. No. 5,300,007 which is a continuation of application Ser. No. 676,299 filed Mar. 27, 1991 now abandoned.

FIELD OF THE INVENTION

This invention relates to a small piece folder and more particularly pertains to a folder adapted to form French folds in small articles such as towels, hospital gowns and the like. The provided apparatus is adapted to precisely form a variety of folds by simple apparatus settings in a rapid manner.

BACKGROUND OF THE INVENTION

The prior art includes many machines adapted to form cross folds and French folds in small laundry flatwork items such as towels.

Sjostrom U.S. Pat. No. 2,754,113 discloses an apparatus for longitudinally folding and cross folding sheet materials including towels by means of air blasts and fold-forming plates after the article being folded has come to a stop and is clamped in fixed position.

Sjostrom U.S. Pat. No. 2,545,798 discloses the sequential forming of longitudinal parallel folds in sheet material by moving side plates on which portions of the sheet material rest over a central plate beneath which a portion of the sheet material lies. Neither of the Sjostrom patents suggests the controlled manner of instantaneous fold formation provided by the apparatus of the invention as will be hereinafter described in detail.

Landgraf et al. U.S. Pat. No. 4,060,227 is directed to a folder for folding small flat pieces by forming a French fold and a cross fold in continuously moving small pieces such as towels by means of air bars and width control blades. The Landgraf et al. apparatus is limited to the folding of small pieces only. The pieces being folded are continuously moving with uncontrolled panel folding.

Kober U.S. Pat. No. 4,093,205 is directed to a laundry folder employing opposed adjustable cam plates for forming a French fold on a moving towel. Also disclosed is an air-discharging bar for forming a cross fold while a towel or the like is traversing a plurality of conveyors while moving through a folder to a stacker. The folder of this patent is incapable of forming the variety of folds formed by the folder of this application and does not suggest the controlled panel folding of this invention.

The folder of this invention is designed to eliminate the major shortcomings of the prior art by providing a versatile folder capable of folding towels of varied sizes in a rapid and efficient manner. The provided apparatus is adapted to form French folds by substantially instantaneously folding opposed side panels of sheet material over a central panel in precise, overlying longitudinal alignment. The prior art does not suggest the instantaneous controlled folding hereinafter described in detail.

It is thus an object of this invention to provide a substantially instantaneous manner of forming French folds in laundry pieces such as towels, napkins and small sheets in the course of which air is progressively rolled out or squeezed from between the lateral and central panels assuring desired and precise panel edge alignment.

It is another object of this invention to provide a folding apparatus adapted to automatically form any of a plurality of desired folds in a towel or the like being processed by means of simple control actuation.

It is still another object of this invention to provide a folder which is readily adaptable to the processing and formation of desired folds in a variety of towels of varying sizes.

It is a further object of this invention to provide a folder which although rapid and flexible in operation is both rugged and compact occupying a minimum of valuable floor space.

The above and other objects of this invention will become more apparent from the following description when read in the light of the accompanying drawings and appended claims.

SUMMARY OF THE INVENTION

In one embodiment of the provided invention a towel feed conveyor of continuous ribbons is provided which conveys a towel or the like beneath spaced parallel runners with opposed lateral towel side panels being carried by conveying ribbons which slidably engage opposed supporting side plates. If the towel has less than a maximum length, air bars sequentially fold the towel side panels over the runners as the towel is moving and conveyed to the end of an upper feed conveyor. The air discharges instantaneously urge each towel side panel in sequence against an air permeable grid disposed over the towel and feed conveyor as each panel is moved over the towel central panel. The air blasts progressively squeeze air from between the side and central panels from the panel hinge connections with the towel central panel to the distal terminal ends of the side panels. The French folded towel may be subsequently cross folded in the course of being urged onto an underlying conveyor and onto the trap doors of a towel stack former as will hereinafter be described in detail.

If the towel being processed is beyond a maximum size which prevents the completion of the sequential panel folding as the towel moves on the upper feed conveyor, the feed conveyor is momentarily stopped to enable the folding steps to be completed prior to the discharge of the folded towel from the end of such conveyor, In the course of travel of the piece being folded through the apparatus the same is constantly monitored as to location and size thereby enabling the desired folds to be made therein with precision, and assuring a trouble-free folder operation,

DESCRIPTION OF THE DRAWINGS

FIG. 18 is a schematic perspective view illustrating drive motors and chains employed in the folder of this invention;

FIG. 19 is a schematic perspective view illustrating a modified half-fold which may be formed in a towel or the like, employing the folder of this invention;

FIG. 20 is a functional block diagram generally schematic illustrating the electrical relationship of apparatus elements in the provided folder.

DESCRIPTION OF THE PREFERRED EMBODIMENTS

The folder of this invention is adapted to form a plurality of attractive folds in laundry flatwork such as towels, napkins and the like. More particularly, the folder of this invention is adapted to fold towels up to 72 inches in length precisely in three parts wherein the opposed lateral panels are folded in overlapping relationship with a center panel to define what is known in the laundry trade as a "French fold". Such folded towel may be then draped over a towel bar or the like presenting an attractive appearance.

Figure 4:
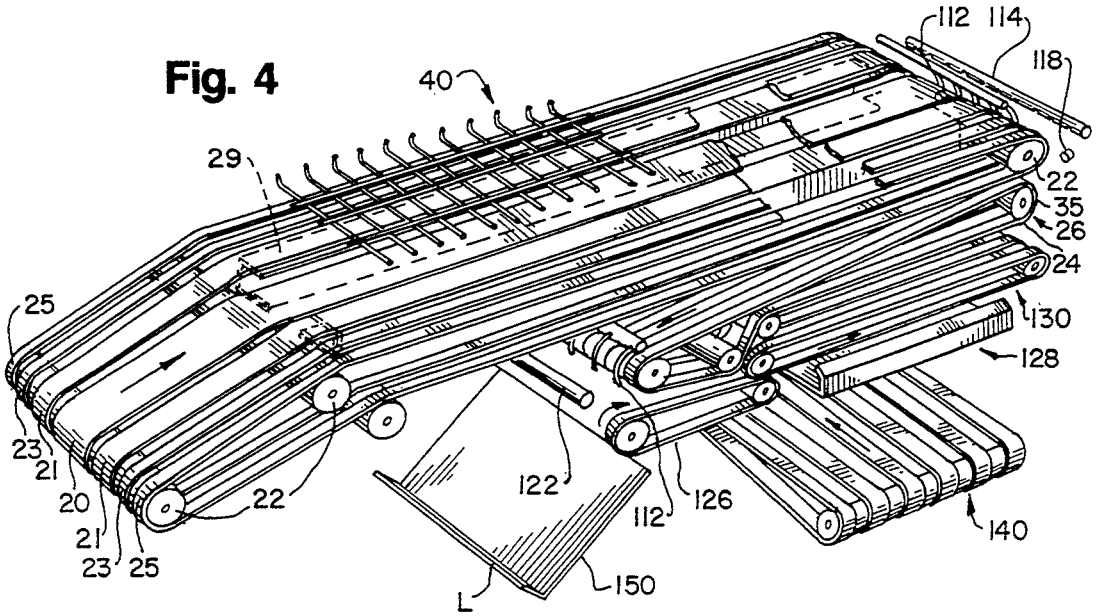
FIG. 4 is a perspective view of the conveyors and certain associated auxiliary apparatus elements employed in the folder construction of this invention.
Figure 6:
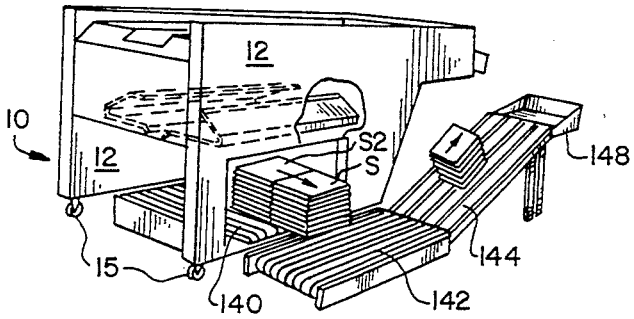
FIG. 6 is a perspective view of a folder made in accordance with this invention partially broken away and illustrating a trap door of a stacker shown in association with conveyors to move stacks of folded articles to the feed end of the folder.
Figure 5:
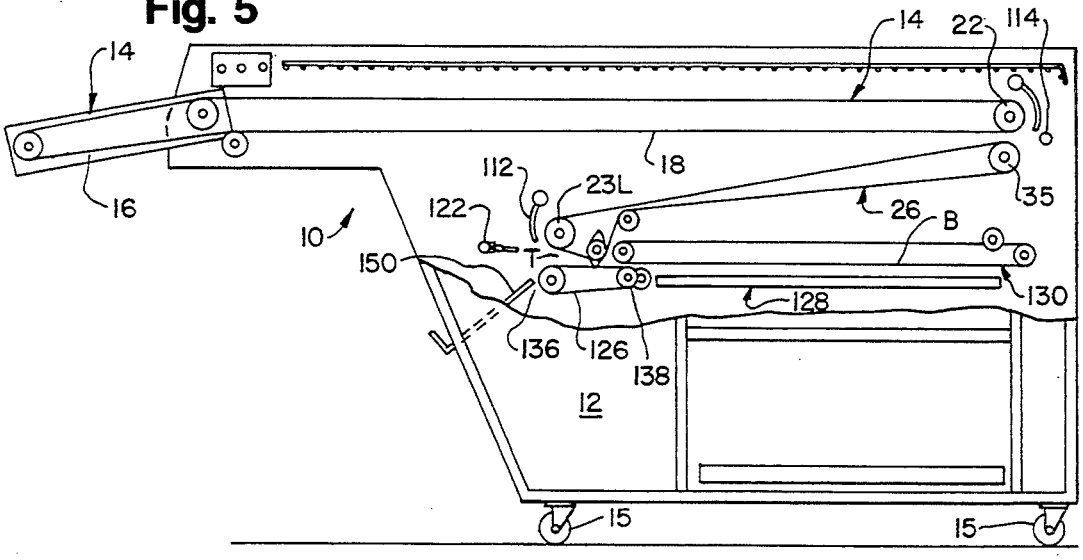
FIG. 5 is a schematic side elevational view of one embodiment of a folder made in accordance with this invention.

FIGS. 5 and 6 illustrate a towel folder 10 made in accordance with this invention, and comprising opposed side frames 12 in which are journaled rotatable rolls some of which rotatably drive continuous belts or ribbons defining overlying conveyors which move a towel, a small sheet or the like through the folder 10. Each frame half 12 may be mounted on casters 15 for ready relocation of the folder when desired. FIG. 5 illustrates an upper feed conveyor 14 comprising an initial upwardly inclined portion 16 which is integral with main horizontal conveyor portion 18. The upper conveyor 14 possesses large central ribbon 20 more clearly seen in FIG. 4, and ribbons 21, 23 and 25 movable therewith and disposed to either side of ribbon 20. Ribbon 20 has approximately the width of the panels of a towel after the same is French folded. Ribbons 20, 21, 23 and 25 move about rolls 22 of the upper conveyor 14 and ribbons 24 of underlying conveyor 26 move to the left in an opposite direction to the ribbons of conveyor 14 as illustrated in FIGS. 4 and 5.

Figure 7:
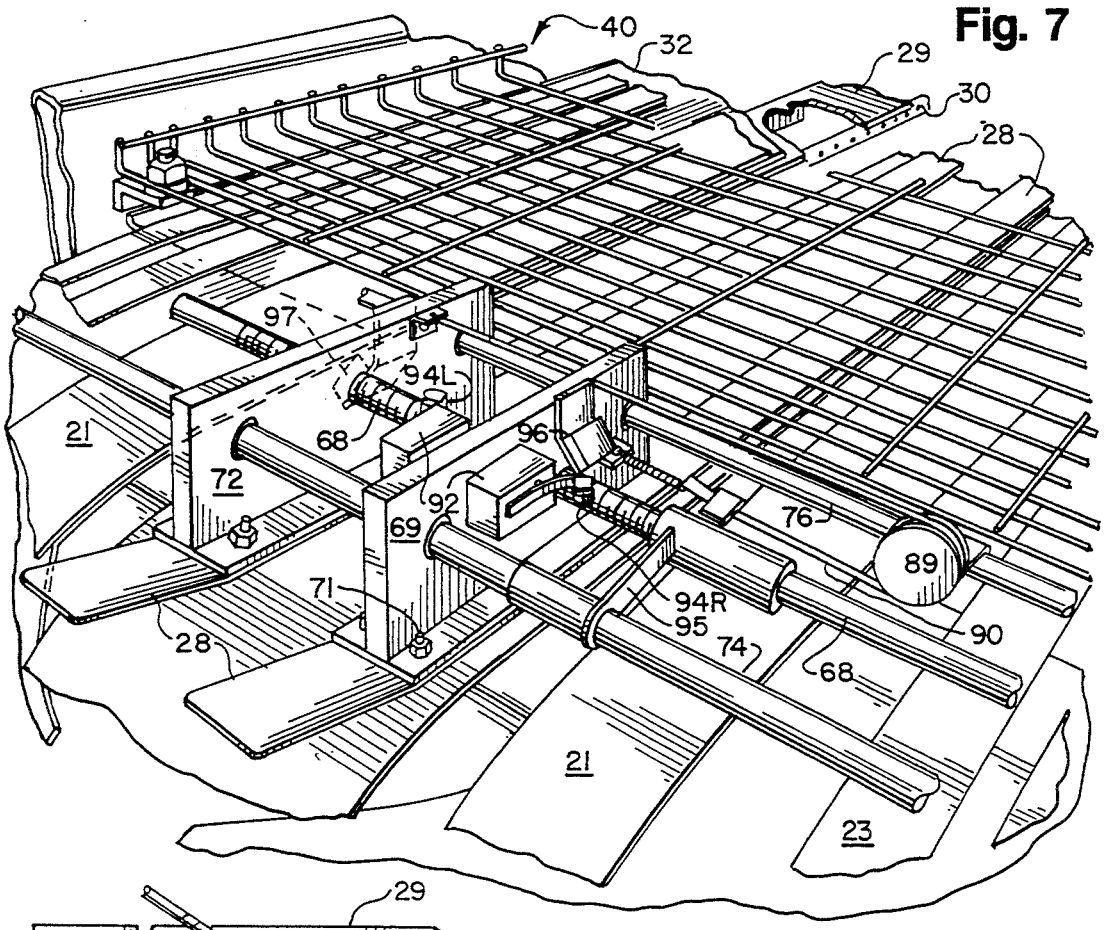
FIG. 7 is a fragmentary perspective view of the feed end of a folder made pursuant to this invention illustrating adjustable fold-forming runners and associated means for forming the interval therebetween.
Figure 8:
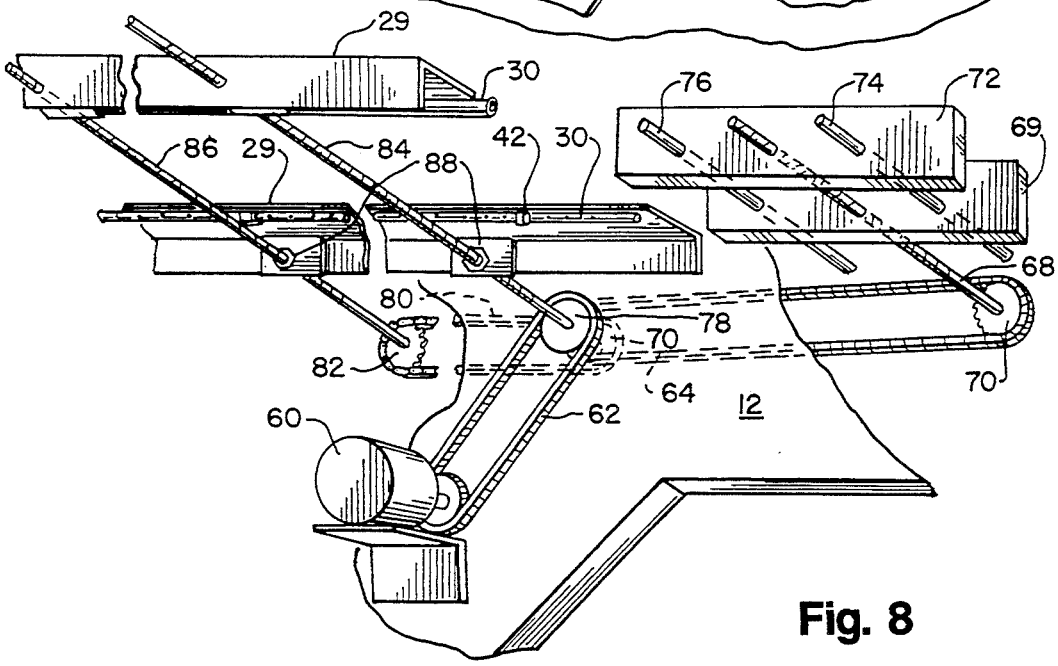
FIG. 8 is a side perspective view illustrating the motor and associated means for adjusting the interval between the fold-forming runners and movable ribbon-support plates of a folder made pursuant to this invention.

It will be more clearly noted from FIGS. 4, 5 and 10–14 that a foldable towel with its leading end centered on inclined portion 16 of upper conveyor 14 prior to moving onto the horizontal upper conveyor portion 18 for purposes of having a French fold formed therein, will be driven by central ribbon 20 moving over a support surface 19 as shown in FIGS. 10–14 as it passes beneath overlying, elongate runners 28 (see FIG. 7). The runners are laterally adjustable and in parallel relation for purposes of forming parallel fold or hinge lines in the course of folding a towel. Opposed panel portions R and L of the towel T are conveyed by the ribbons 21, 23 and 25 simultaneously with movement of the towel center panel on ribbon 20, as clearly seen in FIGS. 10–14. It will be noted from FIG. 7 that the leading edges of runners 28 are upwardly turned to facilitate movement of a towel therebeneath. The towel side portions R and L are elevated relative to the towel center panel C moving beneath runners 28 while supported on wide ribbon 20 as towel panel portions R and L are conveyed by the opposed sets of ribbons 21, 23 and 25 which are slidably driven over fixed, underlying support plates 32 (see FIGS. 7 and 10–14). The plates 32 may be supported at longitudinal intervals by brackets 27 secured to inner walls of the side frames as illustrated, Air bars 30 are supported by the undersurfaces of laterally adjustable elongate plates 29 as seen in FIGS. 7–8. In normal course of adjustment, the upper surfaces of movable plates 29 slidably engage the lower surfaces 31 of plates 32. Plates 29 are supportably mounted on threaded adjusting rods 84 and 86 as seen in FIG. 8.

Figure 10:
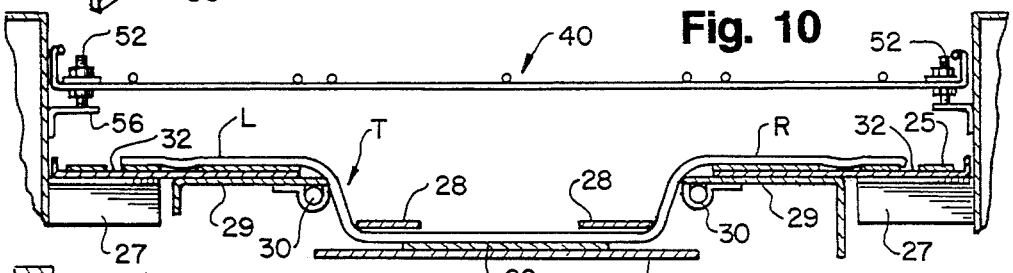
FIGS. 10–14 are sectional views illustrating step-wise the novel folding actions effected in air-initiated folds carried out in a folder of the provided invention. The illustrated fold-forming runners are shown in position for the processing of wide towels or the like in these figures.
Figure 11:
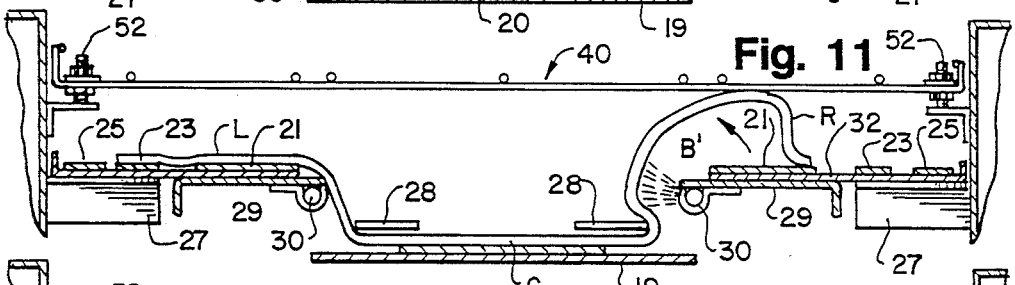
Figure 12:
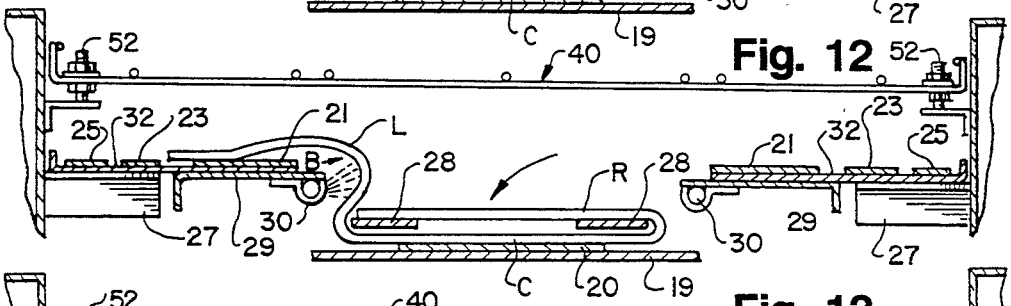
Figure 13:
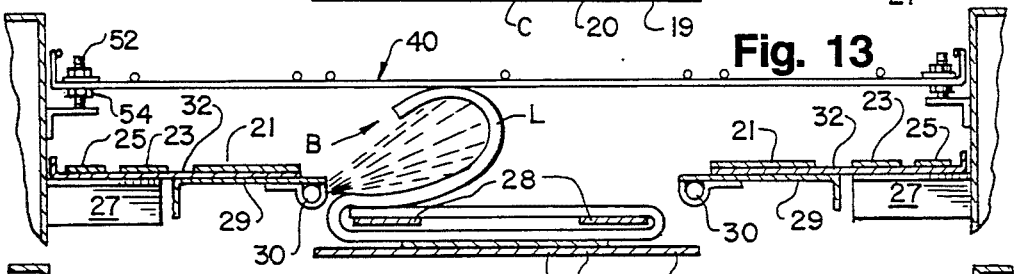
Figure 14:
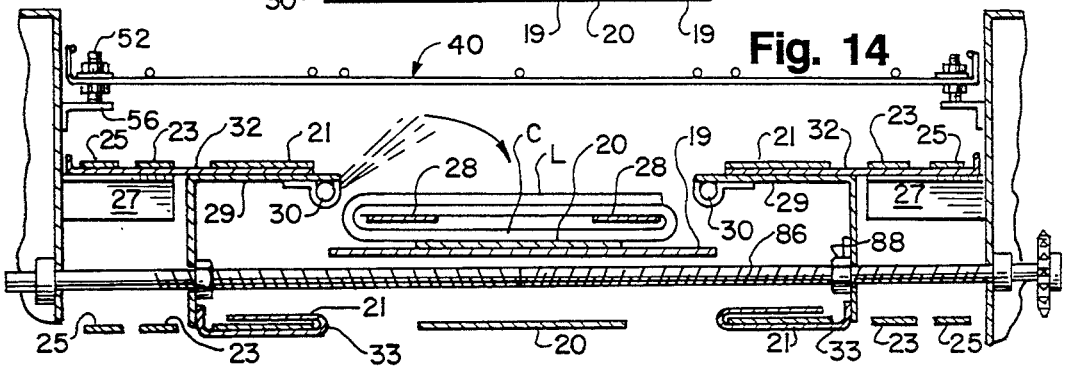

For purposes of forming the desired French fold right towel panel R may be first driven into overlying relationship with the center panel C of the towel T beneath the runners 28 by means of a timed air blast emitted from air bar 30 illustrated in section in FIGS. 10–14. After the right towel panel R is in proper overlying disposition as in FIG. 12, left air bar 30 is activated as illustrated in FIGS. 12 and 13 to urge the left towel panel L into the overlying relationship illustrated in FIG. 14. Ribbons 21, 23 and 25 are preferably surface treated with a plastic or other material to facilitate ready release of a towel portion conveyed thereby.

Particular attention should now be given to overlying air-pervious grid 40. The grid may comprise an open air-pervious arrangement of intersecting rods as illustrated in FIGS. 11–13 and functions as a barrier surface against which the folding towel panels ride in the course of being urged by the air blasts into the folded configuration illustrated. In accordance with this invention the air-pervious grid 40 comprises a stop surface against which the towel panel being folded slidably moves in the course of being folded about the hinge lines defined by the outermost edges of the opposed runners 28. The actual towel fold "hinges" comprise the integral junctures of each side panel of the towel T with the center panel C. As will be apparent from FIGS. 11–13, the air emitted by the air bars 30 forms elongate concavities B on the underside of each towel panel portion as the panel is being folded inwardly along the above-noted hinge lines. It has been found that in the absence of the stop surface provided by the undersurface of the grid 40, the towel panels are forced over the center panel and intervening runners 28 so as to entrap air resulting in an undesired wrinkled appearance in which the longitudinal edges of the panels are not in desired parallel relationship with the longitudinal edges of the towel center panel in the manner illustrated in FIG, 14. Without the controlled air exhaustion illustrated in FIGS. 11–14 there is also the possibility of the overlapping towel panel rebounding upwardly to deleteriously affect a desired edge alignment, A stop surface exemplified by the undersurface of the grid 40 may comprise any air-pervious surface through which air may readily pass upon the engagement therewith of the towel panel being folded.

Figure 9:
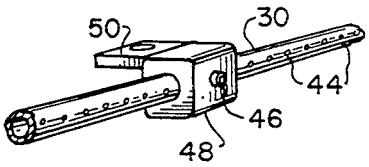
FIG. 9 is a fragmentary perspective view illustrating an air bar clamp which may be employed in the folder of this invention.

The specific angular disposition of the air-emitting openings such as openings 44 illustrated in air bar 30 fragmentarily illustrated in FIG. 9 may be readily adjusted by means of a set screw 46 threadedly mounted in a retention block 48 secured to the undersurface of a slide plate 32. A plurality of such mounting blocks 42 may be secured to the plate undersurfaces at spaced intervals as by means of apertured mounting brackets 50 seen in FIG. 9.

Figure 15:
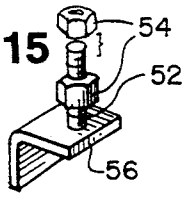
FIG. 15 is a perspective view of a height-adjusting assembly which may be employed in regulating the height of the air pervious barrier employed in a folder of this invention.

The interval between the undersurface of the air-pervious barrier 40 and the underlying plates 42 as well as the runners 28 may be adjusted by means such as a simple stud 52 and nut 54 arrangement illustrated in FIG. 15. By way of example, an interval of three to three and one-half inches has been found satisfactory for the desired air exhaustion. Although the optimum interval will vary with the foldable article material density and weight, such interval may be readily empirically determined. The stud 52 of FIG. 15 is vertically disposed on a mounting bracket 56 secured to a folder side frame in the manner illustrated in FIGS. 10–14. It will be noted from the latter Figures that the stud and nut arrangements are employed in opposite pairs, and a minimum of four is normally needed to support apertured mounting tabs which may be secured to the grid 40 and adapted to be traversed by the studs 52. Lower adjusting nut 54 will precisely locate the grid on the stud after which upper nut 54 is threaded in place for purposes of securing the grid 40 in fixed position. Enlarged washers, not illustrated may be employed in conjunction with the studs and nuts to facilitate mounting of grid 40.

To accommodate towels of varying width, the interval between the runners 28 must be adjustable so that the size of the center panel C and resulting size of the side panels R and L may be adjusted by the operator. The adjustment is designed to form three longitudinal panels each of which is approximately one-third the width of the panel. The interval between the runners 28 is adjusted by means such as a reversible adjusting motor 60 illustrated in FIG. 8. The latter rotatably drives chain or belt 62 clockwise or counter-clockwise whereby threaded rod 84 mounted in sprocket 78 is rotated. Chain 64 rotatably drives sprocket 70 on which the threaded adjusting rod 68 is mounted as more clearly seen in FIG. 8. It will also be noted from the latter Figure that in addition to the threaded rod 68, runner mounting blocks 72 and 70 engage the spaced, unthreaded guide rods 74 and 76 illustrated in FIG. 7.

Chain 62 of adjusting motor 60 also rotatably drives sprocket 70 which rotatably engages chain 80 which in turn simultaneously drives sprocket 82. Mounted on the spaced sprockets 78 and 82 are threaded adjusting rods 84 and 86 respectively. These two rods similarly to adjusting rod 68 have right and left hand threads disposed on the opposed half portions thereof for purposes of engaging threaded mounting blocks 88 secured to the inner flange portions of the spaced adjustable air bar support plates 29 as clearly seen in FIG. 8. The threads are arranged on the rods 68, 84 and 86 so that rotation thereof uniformly adjusts the intervals between plates 29 and between blocks 70 and 72. It will be noted from FIG. 10 that runners 28 are a spaced-apart relation to define a maximum size center towel panel C in the towel to be folded. In FIG. 10 air bars 30 and supporting plates 29 are at an outermost position so as to be desirably located adjacent the opposed outer runner edged as illustrated.

Figure 21:
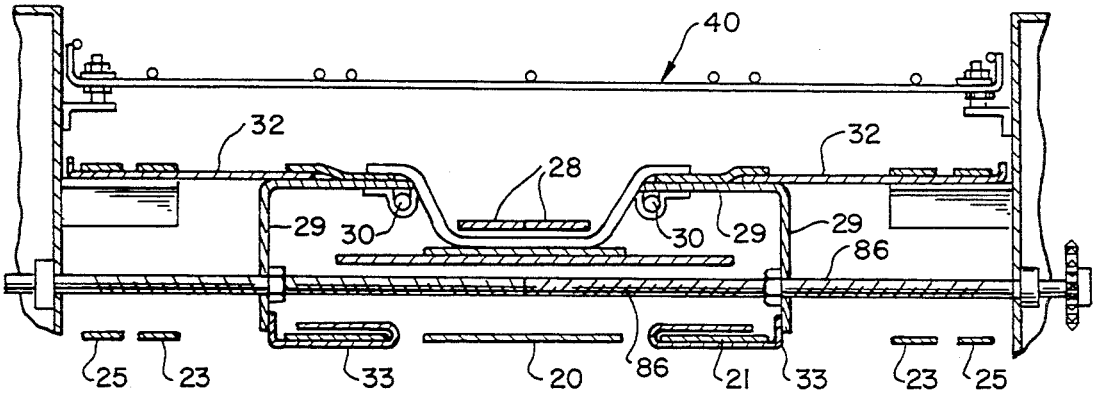
FIG. 21 is a sectional view similar to FIG. 10 illustrating fold-forming runners in adjacent relation for the forming of folds on towels or the like of narrow width.

It will also be noted from FIGS. 10–14 that towel-conveying ribbons 21, together with ribbons 23 and 25 are slidably movable over support plates 32 for the runner relative disposition illustrated. Innermost ribbons 21 have the bottom runs thereof captured within guides 33 as clearly seen from FIGS. 14 and 21. Thus when air-bar support plates are adjusted inwardly into positions such as the innermost position illustrated in FIG. 21 with the runners 28 in abutting edge-to-edge engagement, ribbons 21 will also be inwardly moved because of the engagement with guides 33 secured to the depending flanges of support plates 29 as illustrated.

The interval between the runners 28 may be set by the operator noting the size of the towels being folded and adjusting a control button, the latter will energize reversible adjusting motor 60. The stop means for the adjusting motor may comprise a simple servo-mechanism partly illustrated in FIG. 7 comprising a rotatable potentiometer 89 engaging a belt 90, anchored at opposed ends to plates 70, 72. A predetermined rotatable position of the potentiometer 89 corresponds to a desired interval between the plates 70 and 72 and runners 28.

Such servo mechanism thus comprises a belt-driven rotatable potentiometer 89 which is in a circuit balancing the voltage of any of four selectable, adjustable potentiometers mounted in the folder control board. Each board-mounted potentiometer voltage corresponds to a desired interval between the runners 28 for a particular towel size. When the operator indicates a towel size to be folded, she is in fact, setting a specific potentiometer voltage. The adjusting motor 60 is rotated in the proper direction until the belt-driven potentiometer 89 adjusts a balancing voltage which deenergizes adjusting motor, at which instant the runners 28 are at the desired interval to form the desired size towel panel.

In addition to the set intervals automatically provided by the operator-controlled means including the servo-mechanism 89, the interval between the runners 28 may be manually adjusted when towels or napkins of unusual width are to be folded. The operator will then manually energize motor 60 by means of push buttons which change the interval between the runners 28 until the operator notes a desired runner interval. The maximum and minimum intervals between the plates 70 and 72 are determined by limit switches 92 illustrated in FIG. 7 having switch arms 94R and 94L. The outermost limit of plate movement is determined by engagement of switch arm 94R with arm 95 extending between the threaded adjusting rod and the guide rod 74. Arm 85 is stationary in the normal course of folder operation. Engagement of switch arm 94L with plate 72 determines the minimum interval between the runners 28.

Also illustrated in FIG. 7 is a photo sensor 96 mounted on block 70 and optional twin photo sensor 97 illustrated in phantom line in FIG. 7, which may be mounted on outer wall of block 72 as illustrated.

The photo sensors employed in the folder 10 of this application are well known in the art and may comprise sensors sold under the tradename Micro-Switch, Model FE7B. The sensors emit a light beam which senses a towel or the like being folded and passing therebeneath as the sensed reflected light beam strikes the article being folded. Accordingly, the length of the centered towel which is fed onto the upper conveyor 14 of the folder 10 is automatically sensed for length with the assistance of a programmable controller which stores the impulses generated by the sensor 66 in conjunction with an electronic generator-counter device for generating counts or pulses stored in the programmable controller 98 of the block diagram of FIG. 20 as long as a foldable article is sensed.

In accordance with this invention the French fold formed by the runners 28 in conjunction with the opposed air bars 30 illustrated in FIGS. 11–14 may be formed as the towel is conveyed on the upper conveyor 14. That is, the fold is formed as the towel is continuously moved by the ribbons of the conveyor.

In the event the towel is beyond a maximum length so that adequate time is not present for forming in sequence the overlapping folds illustrated in FIGS. 11–14 on conveyor 14, conveyor 14 is stopped. The programmable controller 98 upon receiving the length-determining pulses during towel sensing by the eye 96 of FIG. 7 will deenergize a clutch, disengaging drive sprocket 100 (See FIG. 18) from drive roll 22 of conveyor 14. It will be noted from FIG. 18 that chain 104 also engages underlying sprocket 106 of main drive roll 35 (FIG. 4) driving the underlying conveyor 26 moving in a direction opposite to conveyor 14, toward the folder feed-end. This relationship between the conveyors 14 and 26 is apparent from Figures such as 4 and 5 of the drawing.

It will be noted from FIG. 18 illustrating the drive chain and sprocket systems employed in the provided folder 10, that although the upper conveyor 14 will stop when towels of beyond a maximum length are sensed, underlying conveyor 26 is continuously driven by sprocket 104. It will be noted from FIG. 18 that drive sprocket 106 of underlying conveyor 26 engages not only the chain 104 but in addition engages a second drive chain 110 by means of a second drive sprocket mounted behind sprocket 104 and not seen in FIG. 18.

Assuming that the towel length exceeds the maximum length able to be folded while moving on upper conveyor 14; such towel is stopped until the folds of FIGS. 11–14 are formed. As a shorter moving towel will have the French fold formed before leaving the upper end of conveyor 14, folder 10 need not be stopped. As a longer towel will be partially on the conveyor 14 and partially off the conveyor 14, if the latter were continuously moving, in the process of having the panels folded into the configuration of FIG. 14, it is necessary that the conveyor 14 be stopped to allow completion of the French fold. The two folds together require less than one-half second however it is intended that the conveyor speeds be of the order of 160 feet per minute.

It is obvious that in a shorter length towel the amount of air employed in forming the side panels over the center panel may not be as great as employed in folding a longer towel. The latter is normally also heavier, and thus a greater amount of air and air pressure is deemed necessary for forming the side panels over the center panel in forming a French fold. Accordingly, two sets of air valves are associated with an air compressor for allowing a lesser volume of air to form the French folds with smaller and normally lighter towels than is required for the heavier and longer towels which are folded after the same have come to rest. Thus FIG. 20 refers to first and second French air valves the solenoids of which are activated by controller 98 in accordance with the length of towel being folded. Coil 93 of the "1st French air valve" is seen in FIG. 20 as is coil 99 of "2nd French air valves".

First Cross-Fold

Figure 1:
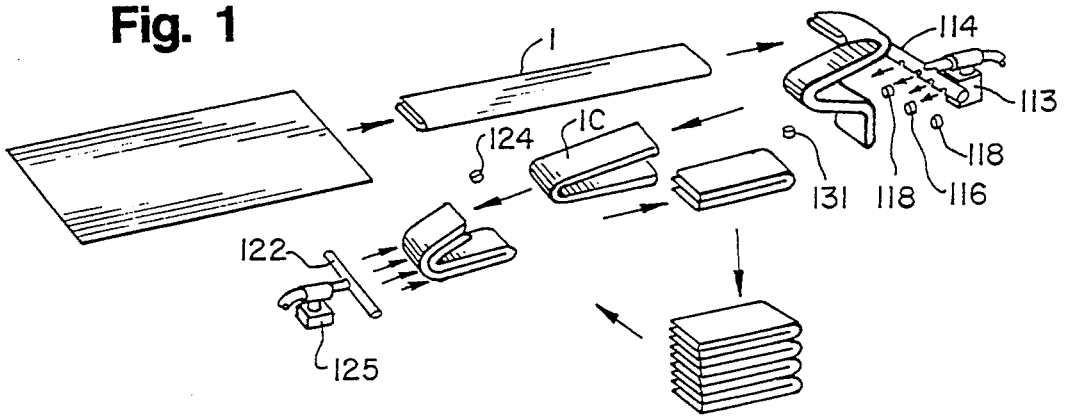
FIGS. 1, 2 and 3 are schematic perspective views illustrating various folds which may be made utilizing the folder of this invention.
Figure 2:
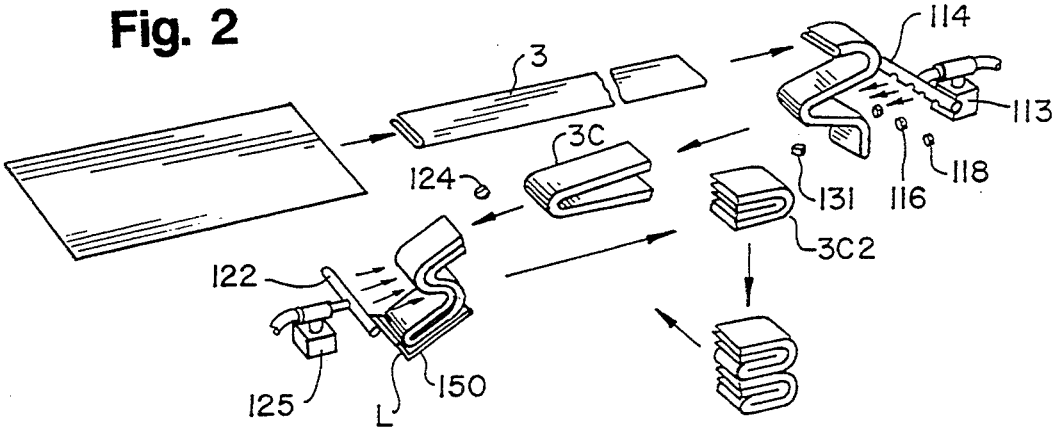
Figure 3:
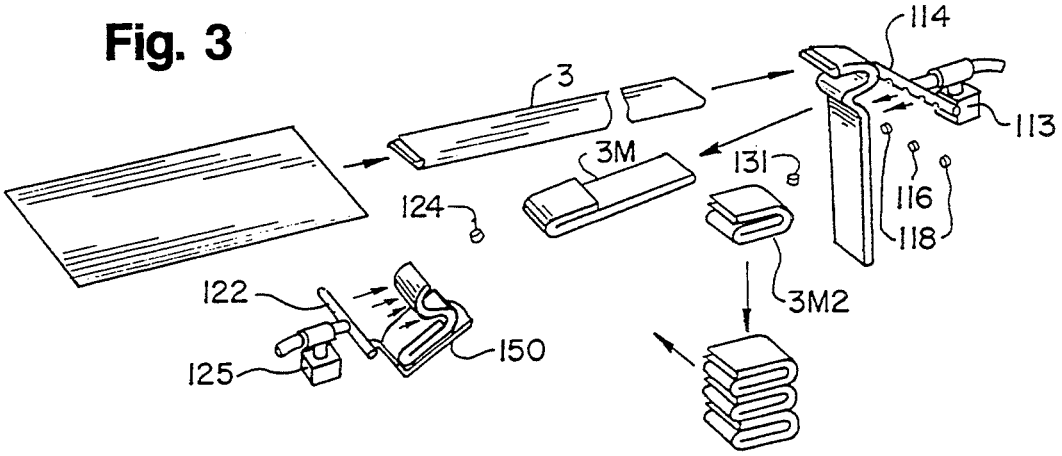

As the conveyor speed of the provided folder is of the order of 160 feet per minute, it will be noted from FIGS. 4 and 5 that an appropriate guide such as guide fingers 112 is employed for guiding the folded towel being conveyed by the continuous ribbons 20 of upper conveyor 14 into a downwardly direction. Solenoid 113 of an air bar 114 is then activated so as to have air from bar 114 drive substantially the mid point of the French folded towel into the bite of the overlying drive roll 22 of upper conveyor 14 and underlying roll 23 of underlying conveyor 26. Coil 101 of the controlling solenoid of the 1st cross air valve is referred to in FIG. 20. Air valve 113 controlling the emission of compressed air through the air bar 114 is actuated with the assistance of a center photosensor 116 having disposed to either side thereof misalignment photo sensors 118 as seen in FIGS. 1 through 3. If the French folded towel such as towel 1 illustrated in FIG. 1 is sensed by the photo sensor 116 and not by either photo sensor 118 in the course of dropping from upper conveyor 14, an air blast from air bar 114 is emitted as illustrated in FIG. 1 so as to drive the mid point of the French folded towel i into the bite of the opposed pinch rolls 22 and 23 of PIG. 4. The air valve solenoid allowing air to be emitted from the air bar 14 is activated by means of a signal from controller 98. The photosensor 116 is so located relative to pinch rolls 23 and 26 that upon sending a signal to controller 98, one-half the length of the already-measured towel (traveling at a known speed) is counted out after which the coil 101 is energized resulting in an air blast from bar 114 as illustrated in FIG. 1 to engage the longitudinal mid-point of towel 1.

It will be noted from FIGS. 1 and 4 that the cross folded and French folded towel 1 proceeds to the left on the ribbons of the underlying conveyor 26 until engaging a second set of curved guide fingers 112 which guide the end of the cross-folded towel of FIG. 1 downwardly opposite to air bar 122. In the event the towel 1 depending opposite the air bar 114 in FIG. 1 is misaligned, it will be sensed by either of the misalignment photosensors 118. A signal from a sensor 118 to controller 98 prevents the first cross air valve 113 from being activated. The towel 1 is thus not folded and is guided by the guide fingers 112 into an underlying collection basket for processing.

If the cross-folded towel 1 of FIG. 1 and proceeding to the left on conveyor 26 is of a small size the leading edge of the towel in the form 1C in the cross folded stage is sensed by photo sensor 124 and the coil of a second cross air valve 125 is activated to emit air from air bar 122 after the appropriate length of the sensed cross-folded towel is counted out so that the leading edge of the sheet 1C is driven onto the ribbons of conveyor 126 more clearly seen in FIG. 4. Conveyor 126 is continuously driven at sprocket 127 (FIG. 18) which engages chain 129 driven by sprocket 131 of the continuously moving conveyor 23. Chain 129 also engages idler tensioning sprocket 133.

Figure 16:
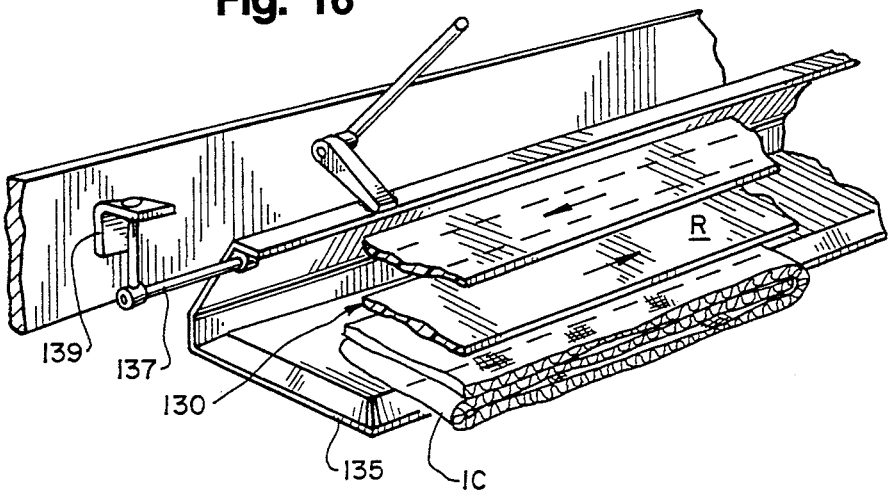
FIG. 16 is a fragmentary perspective view illustrating a portion of a trap door employed in the stacking device of the folder of this invention.
Figure 17:
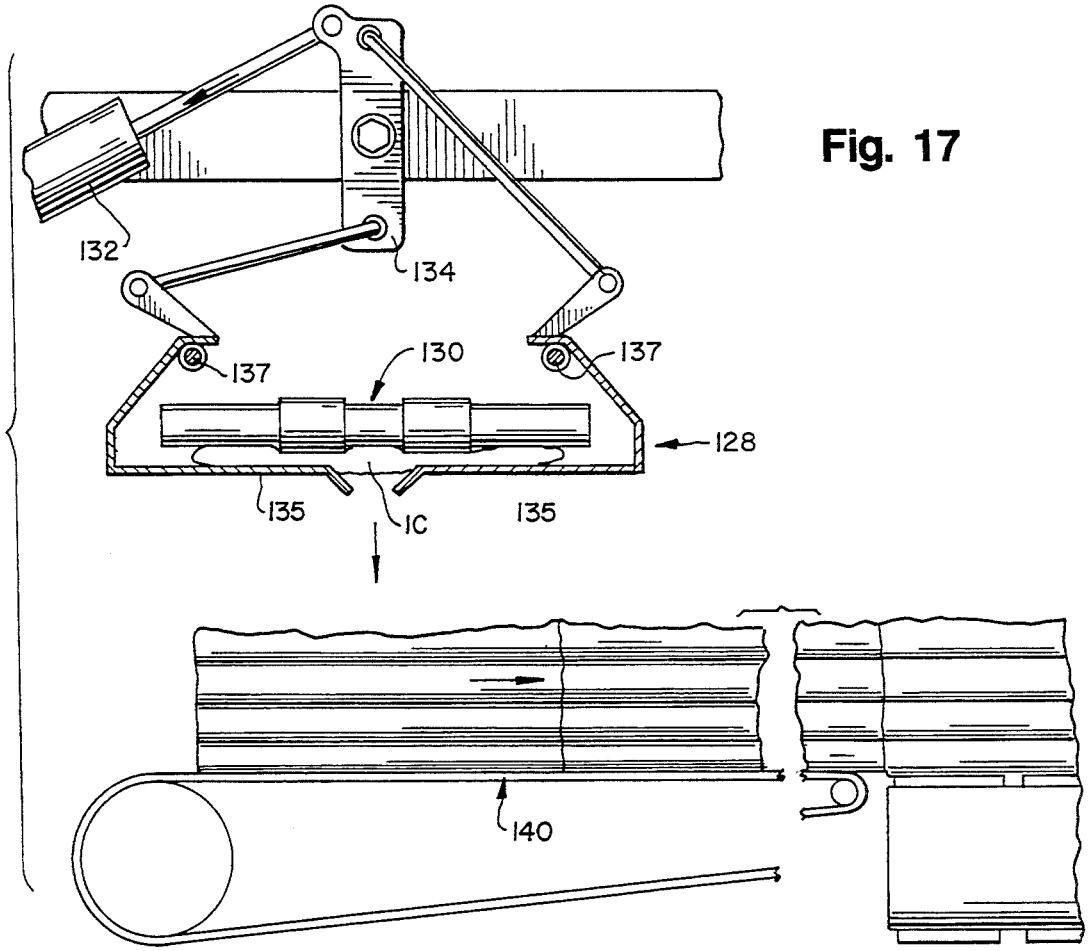
FIG. 17 is a fragmentary end elevational view partly in section, illustrating a trap door arrangement employed in the folder of this invention, and illustrated in overlying relationship with a conveyor for removing stacks of folded articles.

The top surface of the towel 1C as illustrated in FIG. 1 and moving to the right is then driven onto the upper surface of a stack-forming trap door 128 one-half 135 of the trap door being illustrated in FIGS. 4 and 16. As the towel 1C is moved onto the trap door 128 it is frictionally engaged by bottom runs R of the ribbons conveyor 130 (FIG. 16) overlying trap door 128, until leading edge of the towel 1C is sensed by a photo sensor 131 (see FIG. 1). Conveyor 130 preferably runs at a slightly greater speed than conveyors 14 and 26. Upon a signal from trapdoor photo sensor 131 to the controller 98, drive motor 146 (FIG. 18) of conveyor 130 is stopped and after a short time delay, the coils 133 (FIG. 20) of the solenoids controlling trapdoor piston and cylinder units 132, one of which is fragmentarily illustrated in FIG. 17 are energized so as to pivot straps such as strap 134 illustrated in FIG. 17. Strap 134 actuates the toggle connections to the twin half doors 135, as the half doors 135 pivot around supporting rods 137 supportably mounted on support brackets 139 one of which is illustrated in FIG. 16. A towel such as the illustrated towel 1C of FIG. 17 compressed between the ribbons 22 of the conveyor 130 and the upper surfaces of the trap door halves 135 is then dropped substantially vertically onto an underlying stack formed on an underlying return conveyor 140 also illustrated in FIGS. 4 and 6. The drive roller of the conveyor 140 is driven by a cross conveyor motor 141 of the block diagram of FIG. 20. The stacks of predetermined number such as seen in FIGS. 1 and 6 are carried by the ribbons of cross conveyor 140 after formation, onto the ribbons of a horizontal conveyor 142 which is driven simultaneously with adjacent elevation conveyor 144 by means such as a drive motor 146 as seen in FIG. 18. Elevating conveyor 144 of FIG. 6 delivers the stacked towels onto a platform 148 adjacent to the folder operator at the feed end of the folder 10 whereupon the operator feeding the towels into the folder 10 may deposit such stacked towels into a cart for removal from the premises.

As noted above, the apparatus 10 is adapted to not only fold towels of varying length as the towels are either moving or as the towels are stopped, and in addition is adapted to form a variety of cross folds in a French folded towel. Such flexibility enables the provided folder to efficiently process towels of a wide range of sizes, while effecting a variety of folds.

Thus in FIG. 2 a French folded towel 3 which would normally be longer than the towel 1 of FIG. 1 is cross folded in the same manner as towel 1 of FIG. 1 and proceeds to the left in the form of a towel 3C which has been French folded and cross folded once. As above described, the once cross folded towels as processed by the apparatus 10 move toward the feed end of the folder on the underlying conveyor 126 and are appropriately urged onto the conveyor 126 by air bar 122 after being guided about the lower guide fingers 112 and being sensed by sensor 124.

It will be noted from FIG. 2, however, that the towel 3C has its leading edge in engagement with lip L of support plate 150 more clearly seen in FIG. 4. With the leading bight edge of the cross folded and French folded towel 3C in the position of FIG. 2 resting on the lip L of the plate 150, air bar 122 is activated. The midpoint of towel 3C is then driven into the converging throat T (See FIG. 5) defined by the left end of conveyor 26 moving about left roller 23L and by the conveyor 126 moving at the left about roller 131 and at the right about drive roller 133. The twice cross folded and French folded towel in the form of 3C2 of FIG. 2 is then driven by the bottom runs of the continuous ribbons R of conveyor 130 after leaving the ribbons of conveyor 126 and being driven onto upper surface of the trap door 128 in the manner apparent from FIG. 16. Towel 3C2 is French folded and cross folded into quarters.

It will be noted from FIG. 20 that in accordance with the selection made by the operator of folder 10 in the selection of the "fold selector" the drive motor 60 is energized to move the attached runners 28 and the plates 32 into appropriate spaced apart relationship with the assistance of servo-mechanism potentiometer 89 of FIG. 7. Similarly, in accordance with the particular type of cross-folds or folds desired in the French-folded towel, signals from the controller 98 will activate the air bars 114 and 122 after the appropriate fraction of the French folded towel has dropped in front of the openings 44. The air blasts will be emitted by in such air bars after the desired towel fraction has been "counted out" by the counter of the controller which occurs following sensing of such towel by the appropriate sensor 116 or 124 respectively.

FIG. 3 illustrates a towel 3 which would normally be longer than the towel 1 of FIG. 1. If the machine operator had set the "fold selector" input illustrated in FIG. 20 for a French-folded towel cross folded into thirds, the sequence of FIG. 3 would take place wherein the cross folded towel in the form of 3 depends on the end of the upper conveyor 14. A signal from the controller 98 following towel sensing by sensor 116 activates the air bar 114 so that the illustrated cross fold is formed with approximately one-third of the towel 3 remaining in engagement with the conveyor 14 and the runners 24 disposed thereover. The towel engagement with the runners prevents the entire towel 3 from falling from the end of the upper conveyor 16 despite the fact that approximately two thirds of the towel 3 is hanging in the vertical plane. On activation of the air bar 114 the towel in the form 3M moves to the left whereupon it is sensed by sensor 124 prior to moving onto support plate 150. The counter of the controller 98 will then emit a signal in response to the counter read out, opening the air valve 125 of air bar 122 so as to form the final fold as illustrated in FIG. 3 dividing the French folded towel 3M in half, now cross folded into thirds as it enters into the bite formed by the converging conveyor belts 126 and 26 (see FIGS. 4 and 5), until engaged by the bottom runs of transfer conveyor 130 as previously described. After the second cross fold effected by the air bar 122 in FIG. 3, the folded towel in the form of 3M2 is sensed by photo sensor 131 while being driven over the surface of the trap door 128 whereupon motor 102 driving conveyor 130 is stopped, and such cross folded, French folded towel is dropped vertically onto the partially formed stack illustrated.

It has been found that precisely formed stacks may be moved without twisting or misalignment upon being discharged from cross-conveyor 140 illustrated in FIG. 6 onto conveyor 142 prior to being placed upon elevating conveyor 144 for arrival at platform 148. The technique of avoiding any misalignment requires that the upper surface of cross conveyor 140 be disposed slightly above the level of conveyor 142 enabling the formed stack such as the two stacks illustrated in FIG. 6 to be partially in overlying relationship with the ribbons of conveyor 142 while the majority of the area of the bottom towel of the stack rests upon the ribbons of conveyor 140. Upon actuation of the conveyor 140 to move the formed stack onto the ribbons of conveyor 142, stack S2 will in fact push the stack S completely onto the ribbons of conveyor 142 without any portion of stack S remaining on conveyor 140. As a result, when conveyor 142 is actuated to move in the direction of the shelf 148 on conveyor 144, stack S moves axially without any twisting or turning occasioned by being partially on conveyor 142 and partially on conveyor 140.

The provided folder 10 also possesses a jam detector 152 indicated in FIG. 20. Such jam detector is actuated to cut off the electrical power to the apparatus 10 if a towel sensed by the first photo sensors does not arrive at the following photo sensors within predetermined time limits. Such failure to arrive is evidence of jamming or other malfunction which may have occurred and accordingly the electrical power input to the main drive motors is terminated on the expiration of any interphotosensor time interval pre-set in the controller which is based on the known time interval which transpires in towel movement through folder.

FIG. 20 also illustrates a reject button which is actuated by the operator who may notice a defect in a towel being fed into the folder after the initial portion of the towel has already passed onto the upper feed conveyor 14. Upon noticing such defect the operator merely pushes a reject button which inactivates the first cross fold air valve 113 and as a result no air is emitted by air bar 114 allowing the towel to drop into an underlying collection basket.

Folder 10 is adapted to merely longitudinally fold a small towel or large napkin in half and avoid a French fold formation wherein a towel is folded longitudinally into panels of approximately one third the width of the towel. Such fold is effected by centering a small towel so that the fold line is coincident with the outer edge of one runner 28 only of the apparatus 10. Such an arrangement may employ a pair of photosensors 96 and 97 rather than a single photo sensor 96 as would normally be employed when a French fold is to be formed on the towels being processed. When employing the two fold photo sensors 96 and 97 of FIG. 7 each photo sensor controls the air valve for its respective air bar disposed adjacent a runner 28. Accordingly if towels of normal width are fed into the apparatus 10 both sensors are actuated and two air valves are actuated in conjunction with the two runners and air bars so that the French folds of FIGS. 1, 2, 3 may be formed in the manner above described. If, however, a towel is fed into the apparatus so as to be sensed by one photo sensor only and is also centered so that the fold line of the half fold being formed is as shown in FIG. 18 is aligned with the central axis of the towel, one air bar only will be actuated as illustrated to form the half fold in conjunction with a single runner. The half folded napkin or towel H illustrated in FIG. 9 may if desired proceed through the remaining apparatus for a cross fold sequence.

It is apparent that all cross folds may be eliminated by programming the air bars so as to force the leading edge of the half folded or French folded towels into the bite of the counter rotating rolls of the conveyor systems illustrated as the foldable article proceeds through the sequence of conveyors onto the trapdoor 128.

It is thus seen from the foregoing description that a novel towel folder or the like has been provided which forms precise folds in a rapid manner. The folds although being formed instantaneously are controlled so as to completely exhaust the air from the towel side panels in the course of being instantaneously folded over an underlying runner and center panel. The manner of controlled folding provided whereby the folding panel slides against an overlying air-pervious guide surface assures the desired exhaustion of air and absence of bubble formation in the overlying panels of the French fold formed. Benefits provided by the novel fold forming apparatus of this invention become increasingly important if finely-woven fabrics are folded which are more susceptible to air entrapment. Although a plurality of controlled folding operations have been described, the elements necessary for the various variety of folds described are readily available. The microcontroller 98 may be a shelf item such as a Model No. F2-40 MRVR manufactured by Mitsubishi Electric Corp. The circuitry employed in conjunction with the microcontroller board is not advanced as inventive per se, the circuitry employed in forming the cross folds being known to the art and similar to that described in co-pending Kober et al. application Ser. No. 07/480716 assigned to the assignee of the subject invention, and the disclosure which is incorporated herein by reference. The provided apparatus in addition to forming a French fold in foldable pieces which may be transversely folded into quarters or thirds or other desired fraction, is also adapted for the folding of foldable flat pieces longitudinally in half.

The provided apparatus although simple in construction is rugged and durable and able to run at high speed for extended time periods. The ability of the folds described to be formed in articles while moving or at rest enables the folder to efficiently process a wide range of article sizes, thereby emphasizing the versatility of the folder of this invention.

It is believed that the foregoing detailed description has made apparent to those skilled in the art a number of variations and modifications that fall within the broad ambit of the invention disclosed. Although the foregoing description has been somewhat specific to the folding of towels of various sizes, other items of laundry flatwork may be processed by the folder described. Such items by way of example and not limitation include hospital gowns, napkins and small sheets. It is intended therefore that this invention be limited only by the scope of the appended claims.

What is claimed is:

1. An apparatus for folding flatwork articles comprising:

a lower conveyor member adapted to carry a first portion of an article disposed thereon along a path of movement from a forward station to a rear station;

an upper conveyor member positioned at an elevation above the lower conveyor member and substantially coextending with the lower conveyor member, said upper conveyor member adapted to carry a second portion of the article simultaneously with movement of said first portion on the lower conveyor member;

an edge-defining member disposed at an elevation between the upper and lower conveyor members for forming a hinge axis between said first and second portions of the article; and an air discharge device disposed at an elevation between the upper and lower conveyor members for folding the second portion of the article about the hinge axis of the edge-defining member and into overlying relationship with the first portion of the article.

2. The apparatus of claim 1 wherein the air discharge device is adapted to urge the second portion of the article in a lateral direction toward the edge-defining member.

3. The apparatus of claim 2 wherein the air discharge device is adapted to urge the second portion of the article upwardly off of the upper conveyor member.

4. The apparatus of claim 1 wherein the air discharge device is disposed at an elevation above the edge-defining member.

5. The apparatus of claim 4 wherein the air discharge device is disposed adjacent an edge of the upper conveyor member nearest the edge-defining member.

6. The apparatus of claim 1 wherein the air discharge device has an air-emitting opening, the angular disposition of said air-emitting opening being adjustable to direct a blast of air in a desired direction.

7. The apparatus of claim 6 wherein the air discharge device comprises a plurality of air bars each having an air-emitting opening, said air bars being independently adjustable to produce a desired angular disposition of their associated air-emitting openings.

8. The apparatus of claim 1 wherein the air discharge device is adapted to fold the second portion of the article over the edge-defining member while the upper and lower conveyor members are moving such that the article is continuously conveyed from the forward station to the rear station during the folding operation.

9. The apparatus of claim 1 wherein the air discharge device is adapted to emit a variable volume of air to compensate for various size and weight articles.

10. The apparatus of claim 1 wherein the air discharge device is adapted to substantially instantaneously fold the second portion of the article over the edge-defining member.

11. The apparatus of claim 1 wherein the edge-defining member, upper conveyor member and air discharge device are laterally adjustable toward a centerline of the lower conveyor member to accommodate various width articles.

12. The apparatus of claim 11 wherein the edge-defining member, upper conveyor member and air discharge device are simultaneously adjustable by an actuating mechanism.

13. An apparatus for folding flatwork articles comprising:

conveyor means for moving a foldable article along a path of movement, said conveyor means comprising a lower conveyor member adapted to carry a central portion of an article disposed thereon, and a pair of upper conveyor members disposed laterally outwardly of said lower conveyor member, the upper conveyor members being positioned at an elevation above the lower conveyor member and substantially coextending with the lower conveyor member, said upper conveyor members adapted to carry opposite lateral portions of the article simultaneously with movement of said central portion on the lower conveyor member;

an edge-defining member disposed adjacent the lower conveyor member at an elevation between the upper and lower conveyor members for forming hinge axes between the central portion and the lateral portions of the article; and a pair of air discharge devices disposed laterally outwardly of the edge-defining member at an elevation between said edge-defining member and the upper conveyor members, said air discharge devices adapted to sequentially urge the respective lateral portions of the article laterally toward the edge-defining member.

14. The apparatus of claim 13 wherein the air discharge devices are adapted to urge the lateral portions of the article upwardly off of their associated upper conveyor member.

15. The apparatus of claim 13 wherein the air discharge devices are disposed adjacent innermost edges of the upper conveyor members.

16. The apparatus of claim 13 wherein the air discharge devices each have an air-emitting opening, the angular disposition of said air-emitting openings being adjustable to direct a blast of air in a desired direction.

17. The apparatus of claim 16 wherein the air discharge devices each comprise a plurality of air bars having an air-emitting opening, each air bar being independently adjustable to produce a desired angular disposition of their associated air-emitting openings.

18. The apparatus of claim 13 wherein the air discharge devices are adapted to fold the lateral portions of the article over the edge-defining member while the upper and lower conveyor members are moving such that the article is continuously conveyed along said path of movement during the folding operation.

19. The apparatus of claim 18 wherein the upper and lower conveyor members are adapted to stop when the article is beyond a maximum length to allow sufficient time for the air devices to fold both lateral portions of the article.

20. The apparatus of claim 13 wherein the air discharge devices are adapted to substantially instantaneously fold the respective lateral portions of the article over the edge-defining member.

21. The apparatus of claim 13 wherein the edge-defining member comprises a pair of laterally adjustable, spaced apart runners.

22. The apparatus of claim 21 wherein the upper conveyor members and air discharge devices are laterally adjustable toward a centerline of the lower conveyor member.

23. The apparatus of claim 22 wherein the edge-defining members, upper conveyor members and air discharge devices are simultaneously adjustable by an actuating mechanism.

24. The apparatus of claim 13 further comprising a sensing device adapted to detect when only one of the lateral portions of the article is placed on its associated upper conveyor member, at which time said sensing device sends a signal to actuate only the air device associated with said lateral portion to effect a single fold of the article.

25. The apparatus of claim 24 wherein the sensing device comprises a pair of sensors each adapted to detect a corresponding lateral portion of the article on its upper conveyor member, each sensing device adapted to actuate the associated air device.

26. An apparatus for folding flatwork articles comprising:

a conveyor member adapted to carry a central portion of an article disposed thereon a path of movement;

a pair of guide members disposed laterally outwardly from the conveyor member for placement of opposing lateral portions of the article thereon;

an edge defining member disposed above the conveyor member for forming hinge axes between the central portion and the lateral portions of the article;

a pair of moving devices disposed laterally outwardly from the edge-defining member, said moving devices adapted to sequentially fold the respective lateral portions of the article about the hinge axes of the edge-defining member and into overlying relationship with the central portion of the article; and a sensing device adapted to detect when only one of the lateral portions of the article is placed on its associated guide member, whereupon said sensing device sends a signal to actuate only the moving device associated with said lateral portion to effect a single fold of the article.

* * * * *

UNITED STATES PATENT AND TRADEMARK OFFICE

CERTIFICATE OF CORRECTION

PATENT NO. : 5,435,802
DATED : July 25, 1995
INVENTOR(S) : Kasimir Kober

It is certified that error appears in the above-indentified patent and that said Letters Patent is hereby corrected as shown below:

On the Title Page

In the Abstract, lines 8-12, delete the following:

"[The air discharges instantaneously urge each towel side panel in sequence against an air permeable grid disposed over the towel and feed conveyor as each panel is moved over the towel central panel.]"

In the Abstract, lines 14-16, delete the following:

"[from the panel hinge connections with the towel central panel to the distal terminal ends of the side panels.]"

Signed and Sealed this

Thirteenth Day of February, 1996

Bruce Lehman

*Attest:*

BRUCE LEHMAN

*Attesting Officer*

*Commissioner of Patents and Trademarks*